United States Patent [19]

Silver

[11] Patent Number: 5,030,123

[45] Date of Patent: Jul. 9, 1991

[54] CONNECTOR AND PATCH PANEL FOR DIGITAL VIDEO AND DATA

[75] Inventor: C. Kevin Silver, Oradell, N.J.

[73] Assignee: ADC Telecommunications, Inc., Minneapolis, Minn.

[21] Appl. No.: 540,466

[22] Filed: Jun. 18, 1990

Related U.S. Application Data

[63] Continuation of Ser. No. 328,481, Mar. 24, 1989, abandoned.

[51] Int. Cl.[5] ..... H01R 29/00

[52] U.S. Cl. ..... 439/188; 200/51.1; 439/507

[58] Field of Search ..... 439/188, 189, 507, 509, 439/513, 668, 876, 885–887, 889; 200/51.1

[56] References Cited

U.S. PATENT DOCUMENTS

| | | | |
|---|---|---|---|
| 4,070,557 | 1/1978 | Ostapovitch | 200/51.1 |
| 4,087,151 | 5/1978 | Robert et al. | 439/188 |
| 4,274,691 | 6/1981 | Abernethy et al. | 439/188 |
| 4,457,570 | 7/1984 | Bogese, II | 439/507 |
| 4,552,423 | 11/1985 | Swengel, Jr. | 439/507 |
| 4,633,048 | 12/1986 | Komatsu | 439/188 |
| 4,695,116 | 9/1987 | Bailey et al. | 439/188 |
| 4,699,443 | 10/1987 | Goodrich et al. | 439/188 |
| 4,725,241 | 2/1988 | Bertini et al. | 439/188 |
| 4,773,878 | 9/1988 | Hansell, III | 439/497 |
| 4,798,542 | 1/1989 | Asick et al. | 439/188 |
| 4,832,614 | 5/1989 | Jenkins | 439/188 |
| 4,850,888 | 7/1989 | Denlinger et al. | 439/188 |

*Primary Examiner*—Paula A. Bradley

*Attorney, Agent, or Firm*—Davis Hoxie Faithful & Hapgood

[57] ABSTRACT

Electrical connector jacks of type having a first set of parallel fingers along one side of a cavity, which are provided with a second set of fingers contacting respective fingers of the first set within pockets in the jack body, modules for adding a second set of fingers to conventional jacks, and patch panels employing such jacks.

13 Claims, 4 Drawing Sheets

CONNECTOR AND PATCH PANEL FOR DIGITAL VIDEO AND DATA

This is a continuation of copending application Ser. No. 07/328,481 filed on Mar. 24, 1989 now abandoned.

My invention relates to novel electrical connectors particularly suited for use in digital video and data patch panels and the like, and patch panels incorporating such connectors.

BACKGROUND OF THE INVENTION

The recent trend in connectors for data and video, like the general trend in electronics, has been toward miniaturization. The currently preferred connectors are of the rectangular, modular type which employ a row of generally parallel conducting fingers in each of the jack and mating plug, such as the RJ-11 and RJ-45 type connectors.

In general, these connectors are not designed to perform switching functions, although versions of RJ-45 connector jacks in which the removal of the mating plug causes the connection (shorting) of one of the fingers of the jack to another finger of the jack.

It is frequently desirable to provide switching functions in connection with connectors, for example, to permit interruption and diversion of circuits through an external device, or to permit monitoring of circuits. Typically, when using RJ-11 and RJ-45 type connectors, the connector and switching functions in patch panels used for these purposes have been provided by separate devices. Typically, switches or loop cables connecting two connectors have been used.

Recently, Chesterfield Products, Incorporated has offered patch panels having switches mounted behind type RJ-11 jacks, with the switch actuator protruding into the cavity of the jack so that insertion of a plug into the RJ-11 jack also actuates the separate switch. This arrangement has the disadvantages of requiring wiring to connect the switch and jack, and of the space occupied by the combination.

Although the telephone jacks and plug connectors used in old fashioned manual telephone switchboards did provide some circuit switching functions, similar functions do not appear to have been provided in the RJ-11 and RJ-45 type connectors which have a very different construction.

SUMMARY OF THE INVENTION

In accordance with the present invention, a jack is provided with a first set of generally parallel connector fingers along one side of a generally rectangular cavity as are provided for example in RJ-11 and RJ-45 type jacks. Typically, these fingers are secured in conventional fashion at the plug opening side to prevent lateral displacement and the free ends of each are laterally restrained in insulated pockets within the jack, as is done in some RJ-45 jacks. In addition, in accordance with the present invention and unlike standard connectors, a second set of fingers is provided, with one finger in each of the insulated pockets. Each of the second set of fingers is located and arranged so that it makes electrical connection with its corresponding finger of the first set when no plug has been inserted in the jack and so that, when a plug is inserted, the electrical connection is opened.

In accordance with my invention, the second set of fingers can be provided in several ways: by including them in an integral modular connector, by providing them in a separate module which may be mounted on the back of a conventional jack incorporating the first set of fingers, or by attachment to a printed circuit board over which a conventional jack incorporating the first set of fingers is mounted. Patch panels using connectors of this type eliminate the need for expensive separate switches, assure that switching occurs at the time of connection, reduce the likelihood of cross-talk and thereby permit higher data transmission rates, and are smaller than those used in the past.

BRIEF DESCRIPTION OF THE DRAWINGS

FIG. 1A is a view from the plug opening side, FIG. 1B is a cross section along line B—B of FIG. 1A. FIG. 1C is a bottom view.

FIG. 4A is a top view and FIG. 4B is a side view.

DETAILED DESCRIPTION

Figure 1A:
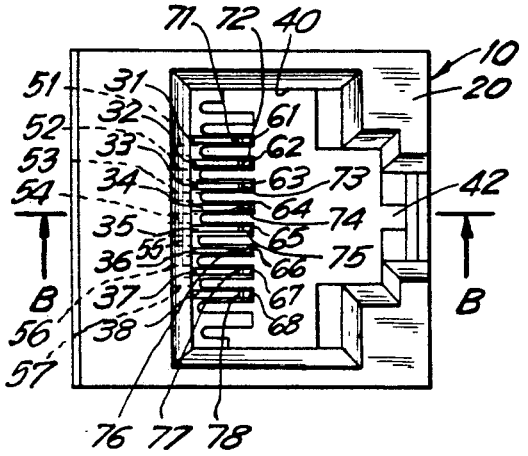
FIGS. 1A, 1B and 1C show various views of a RJ-45 modular jack which has been modified in accordance with my invention.

FIG. 1A shows an RJ-45 connector jack 10 similar to a conventional type made by Stewart Connector Corp., comprising a molded insulating body 20 (typically black PBT polyester plastic) and a plurality of generally parallel fingers 31–38 (typically gold plated phosphor bronze) which correspond to the first set of fingers in accordance with this embodiment of my invention. The fingers 31–38 of the first set are shown in their normal position when no plug has been inserted in the opening of the cavity 40. Raised ridges 51–57 laterally separate and position the fingers 31–38 at the opening side of the cavity 40. Pockets 61–68 in the molded body 20 laterally restrain the fingers 31–38 of the first set, while permitting free movement in the orthagonal direction. (Not all RJ-45 connectors provide such pockets; however, such provision of such pockets by the connector or an adaptor are preferred in accordance with my invention.)

A recess 42 is provided at the side of the cavity 40 for the conventional latch on a conventional RJ-45 plug (not shown) having a plastic body, and a plurality of fingers which are positioned and restrained by the plug body in locations corresponding to the fingers 31–38 of the first set in the jack 10, in accordance with the RJ-45 specification.

In accordance with my invention, the jack 10 also includes fingers 71–78 comprising a second set of fingers. Each of the fingers 71–78 of the second set is present in one of the pockets 61–68 where it contacts a corresponding one of the fingers 31–38 of the first set when no plug is present in the cavity 40 of the jack 10.

Figure 1B:
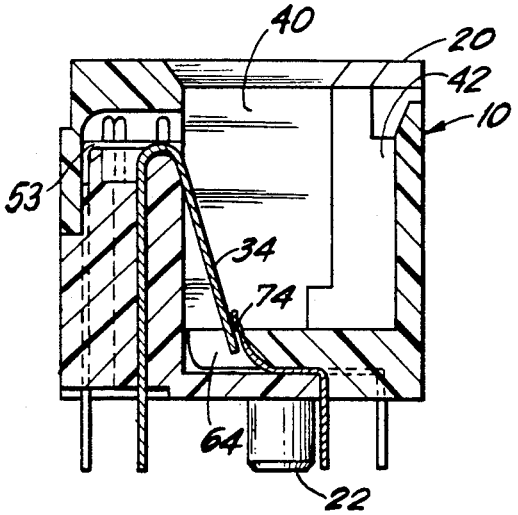

FIG. 1B is a cross section of the jack 10 along a line corresponding to line B—B of FIG. 1A showing both a finger 34 of the first set of fingers and a corresponding finger 74 of the second set of fingers. The fingers are shown in their typical positions when no plug is present in the cavity 40. Fingers 71–78 of the second set each contact and make electrical connection to the corresponding fingers 31–38 of the first set 30 in their pockets 61–68 of the jack body 20 when no plug is inserted in the cavity 40.

When a plug is inserted in the cavity 40, it moves the fingers 31–38 of the first set away from the corresponding fingers 71–78 of the second set, disconnecting them electrically.

Figure 1C:
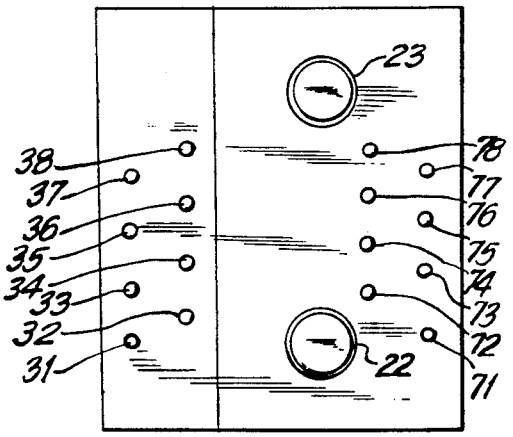

FIG. 1C is a back view of the jack of FIGS. 1A and 1B, showing the location of the mounting lugs 22 and 23, the connector portions of fingers 31–38 of the first set, and the connector portions of the fingers 71–78 of the second set.

Figure 2B:
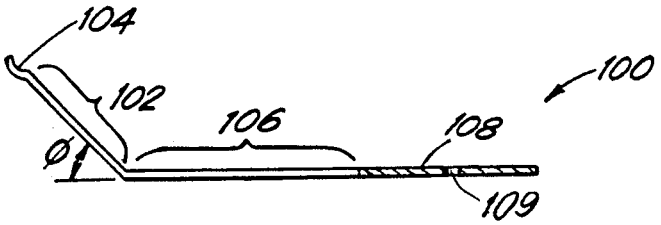
FIGS. 2A and 2B show top and side cross section views respectively of fingers of the second set in accordance with an embodiment of my invention at an intermediate step of manufacture.
Figure 2A:
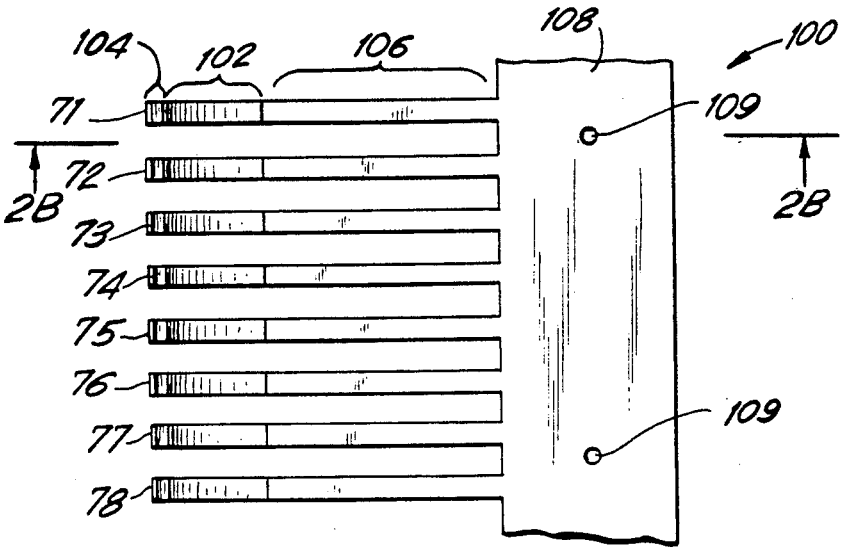

As shown in FIGS. 2A and 2B, the fingers 71–78 of the second set typically are formed from a piece of 0.004 inch beryllium spring copper 100 with gold plating on the end contact areas 102. In this embodiment, for use with a RJ Enterprises Model 8PB8C brand RJ-45 connector as described in connection with FIG. 6 below, the fingers 100 are each 0.017 inch wide and spaced on 0.040 inch centers. The tip 104 of each finger is formed in a semicircle having a 0.020 inch inside radius, the exterior curved surface of the semicircle being the contact surface. The inner (with respect to the cavity 40) end portion 102 is approximately 0.128 inch long and is bent at an angle $\phi$ of $44° \pm 3°$ so that the tip 104 is approximately 0.100 above the base 106. The fingers 100 are joined during manufacturing by a web 108. Locating holes 109 of 0.020 inch diameter are provided in the web. After the fingers 100 are either molded into a connector body or a separate module, or attached to a printed circuit board at the outer ends 106, the web 108 is cut off.

Figure 3:
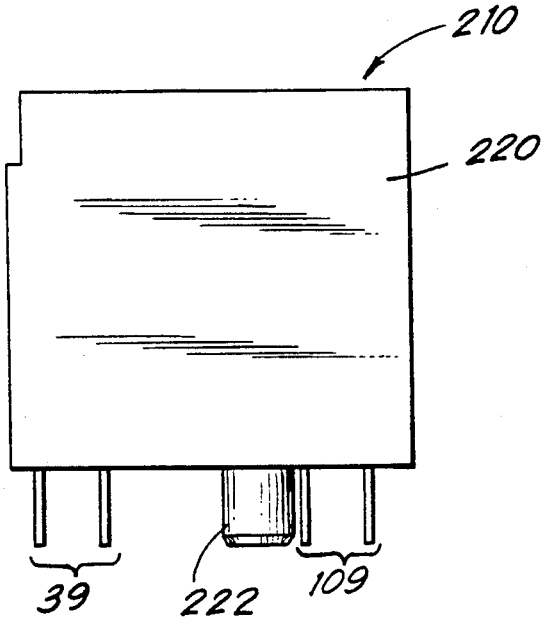
FIG. 3 is a side view of a complete modular connector in accordance with an embodiment of my invention.

FIG. 3 is a side view of a complete module connector 210 in accordance with an embodiment of my invention. The body 220 may be deeper than the body 20 of the connector jack 10 of FIG. 1, to provide support for the second set of fingers 71–78 in accordance with my invention. The outer ends 106 of these fingers have been bent downward in a typical staggered arrangement for connections with a printed circuit board in a manner similar to conventional practice with the outer ends 39 of the first set of fingers 31–38. Alternatively, they can be extended out the side of the jack. The body 220 is provided with a pair of mounting lugs 222, similar to lugs 22 and 23 on body 20 of FIG. 1.

Figure 4A:
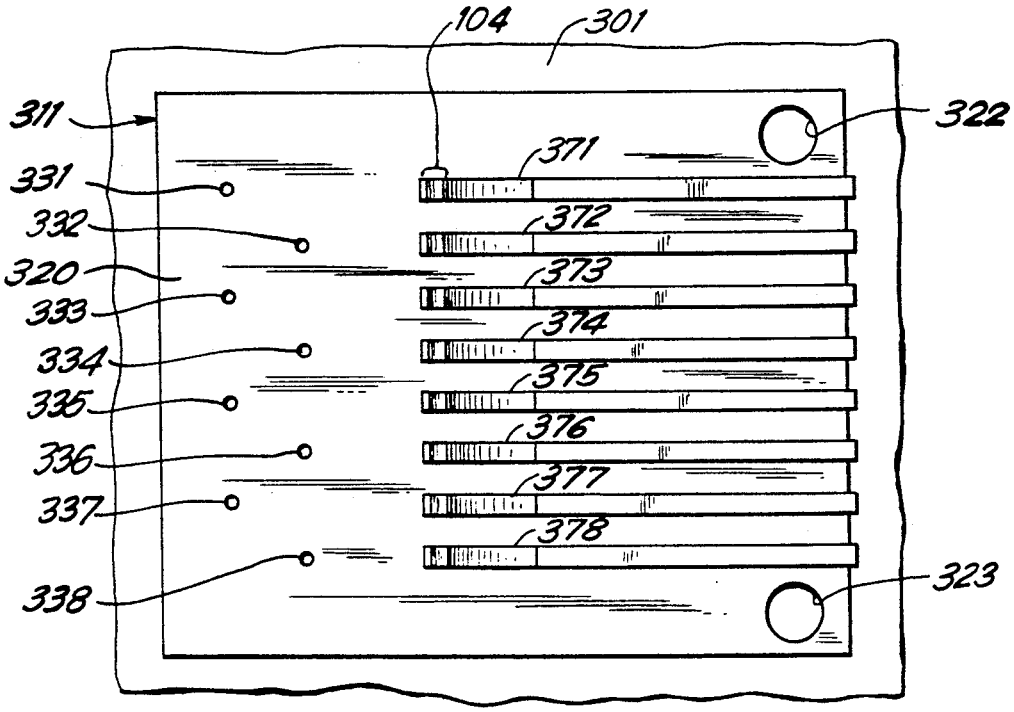
FIGS. 4A and 4B show a module for modifying an RJ-45 jack in accordance with an embodiment of my invention.
Figure 4B:
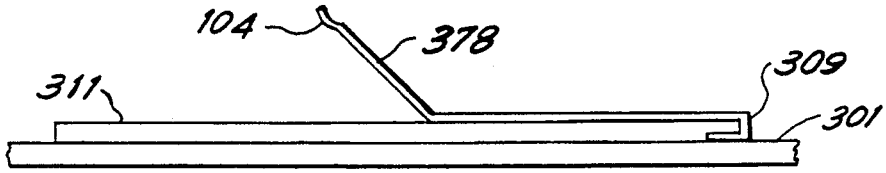

FIGS. 4A and 4B show a module 311 for modifying an RJ-45 jack in accordance with my invention. It comprises an insulating substrate 320 to which fingers 371–378 are molded or otherwise attached. The module is placed on the back of a jack, like jack 910 of FIG. 6, with the tips 104 of fingers 371–378 protruding into the pockets 961–968 and contacting the fingers 931–938 of the first set when no plug is in the cavity, in the same manner as fingers 71–78 of FIG. 1 and finger 974 of FIG. 6. The module is placed between the jack 10 and the printed circuit board 301. Proper location of the module 311 with respect to the jack is provided by lug holes 322 and 323 and holes 331–338 through which the lugs of the jack and the outer ends of the first fingers 31–38 pass. Additional rigidity can be provided for the module 311 by adhering the module 311 to the jack 10 or printed circuit board 301 or both, or by clamping the module 311 between the jack body and printed circuit board 301, or both. In this embodiment, the substrate 320 is relatively thin so that the outer ends 39 of the first set 30 of fingers 31–38 and the lugs 22 of the jack with which this module 311 is used will still function normally in mounting the jack to the printed circuit board 301.

Figure 5:
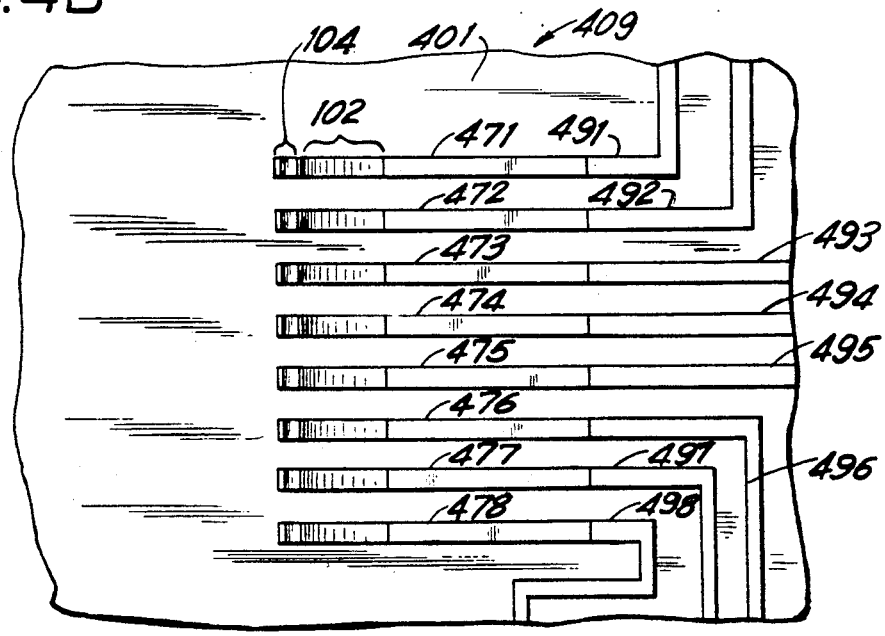
FIG. 5 shows a plan view of a portion of a printed circuit board with fingers of the second set in accordance with an embodiment of my invention.

The outer ends 309 of the fingers 371–378 can be wrapped, for example, around the edge of the module for connection to a printed circuit board as shown in FIG. 5; can be bent in a staggered fashion to serve as pins for connection to a printed circuit board 301; or connected to plated-thru holes; or otherwise provided for connection to a circuit.

FIG. 5 shows a portion of a printed circuit board 401 which has been provided with fingers 471–478 of the second set which operate with an RJ-45 type jack as described above with respect to FIG. 5. In this embodiment, however, a separate module like module 311 of FIG. 4 is not employed. Instead, the fingers 471–478 are directly connected to copper lines on the printed circuit board 401 used for other circuit functions, for example, by welding or soldering at the outer ends 409 to the conductors 491–498 of the board. In a manner similar to the case of the FIG. 4 embodiment, additional mechanical support can be provided by clamping of these fingers 471–478 between the jack body and the printed circuit board 401. As in the other embodiments, the tips 104 and inner ends 102 of the fingers 471–478 protrude into the pockets 61–68 of the jack to function as fingers 71–78 of the second set 70.

Figure 6:
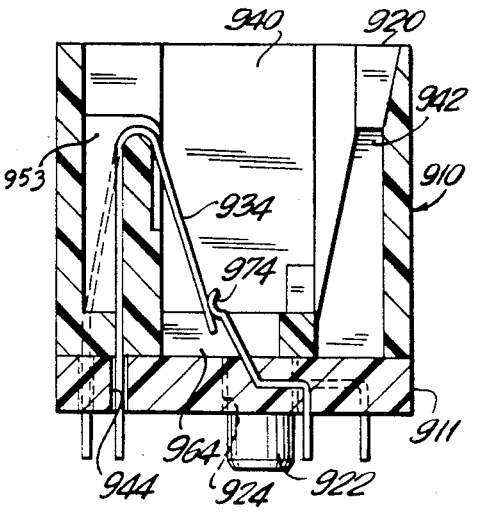
FIG. 6 is a cross-section of a conventional RJ-45 connector jack with an adaptor module in accordance with an embodiment of my invention.

FIG. 6 is a cross-section of a conventional RJ-45 connector jack 910 together with an adaptor module 911. The location of the cross-section corresponds to that of B—B in FIG. 1A, however, the jack 910 of FIG. 6 differs from that of FIG. 1 primarily in that it has an open back and that it does not include an added second set of fingers 71–78. The jack 910 includes ridges (such as ridge 953) separating the fingers (such as finger 934) of the first set corresponding to ridges 51–58 separating fingers 31–38 in jack 10 of FIG. 1A. Similarly, jack 910 has a molded body 920, cavity 940, and latch recess 942 corresponding to the body 20, cavity 40 and recess 42 of jack 10 in FIG. 1.

Module 911, which is mounted below the jack 910, provides fingers of the second set as indicated by finger 974 protruding into the pocket 964 of the jack 910 where it functions in the same way as finger 74 of FIG. 1. Module 911 is provided with holes, such as hole 924 and hole 944 through which the mounting lugs (like lug 922) and the outer or pin ends of the fingers of the first set (like finger 934) extend for mounting and connection purposes.

Figure 7:
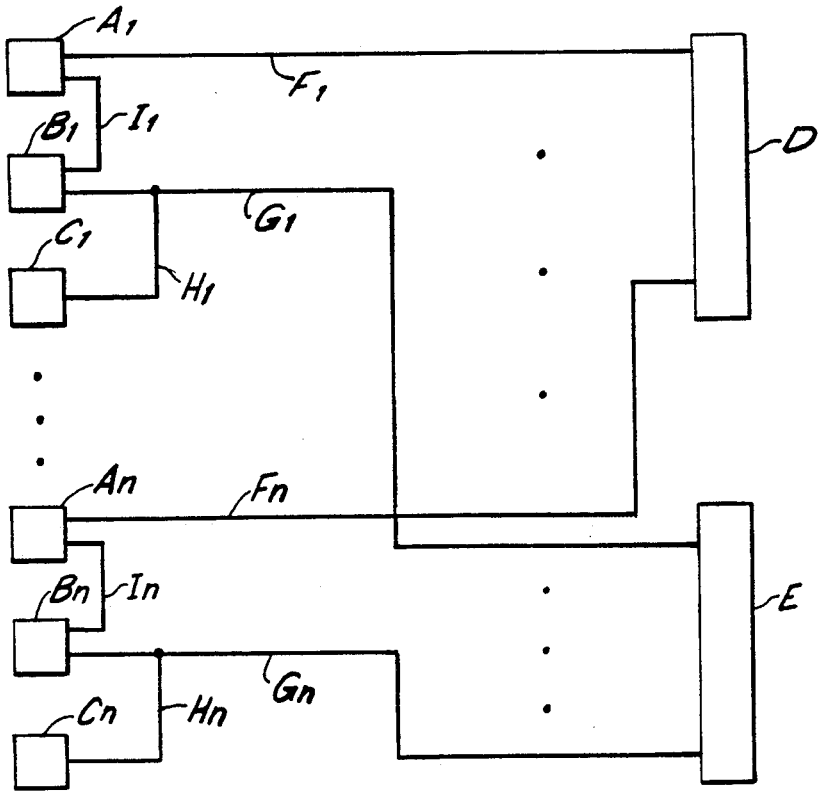
FIG. 7 is a schematic block diagram of a patch panel circuit in accordance with an embodiment of my invention.

FIG. 7 is a schematic block diagram of one circuit of a patch panel in accordance with an embodiment of my invention. A plurality of jacks $A_1$, $B_1$, $C_1$, . . . $A_n$, $B_n$, $C_n$, are provided on the front of the patch panel 501. Although only two sets of jacks are shown, any reasonable number of jack sets can be used without departing from my invention. Jacks $A_{1-n}$ and $B_{1-n}$ are jacks of my invention as disclosed herein. Jacks $C_{1-n}$ can be conventional jacks. These jacks $A_{1-n}$ and $B_{1-n}$ and $C_{1-n}$ are provided for patching and monitoring of signals; however, when no plug is inserted in either of a jack pair $A_x$–$B_x$, the corresponding portions $D_x$ and $E_x$ of the circuit connectors D and E are connected together. The connectors D and E can be of standard type such as 50 pin telephone connectors, or RJ-11 or RJ-45 or other connectors switchable for connections to the associated equipment. In this example, 50 pin connectors are shown servicing a plurality of patch panel jacks. Lines $F_{1-n}$ and $G_{1-n}$ in FIG. 6 each represent busses of a plurality of wires between their respective jacks and connectors, jacks $A_{1-n}$ and connector D in the case of lines $F_{1-n}$, and jacks B1−n and connector E in the case of lines G1−n. Lines $H_{1-n}$ represent busses connecting jacks $C_{1-n}$ respectively to monitor the signals on lines $G_{1-n}$. Lines $I_{1-n}$ represent busses correcting corresponding fingers of the second set in jacks $A_{1-n}$ and $B_{1-n}$. Typically, the jacks A–C and connectors D–E are mounted on a printed circuit board and the lines F–H are printed on the board to form a compact patch panel.

Figure 8:
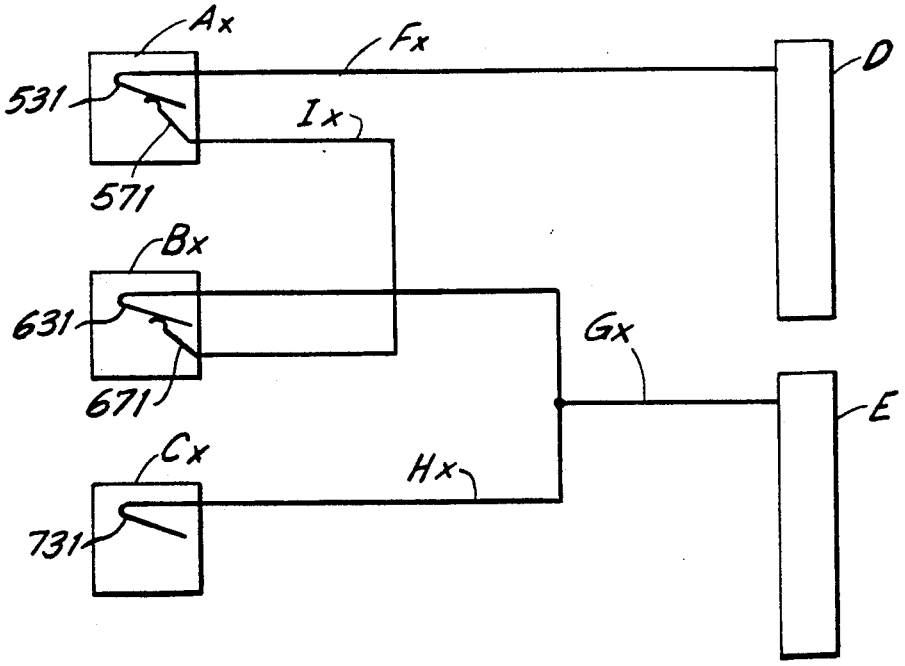
FIG. 8 is a schematic diagram sharing one signal circuit for a patch panel in accordance with the embodiment of FIG. 7.

FIG. 8 is a schematic diagram showing the connections of one set of wires for a single signal in accordance with this patch panel embodiment. Each of jacks $A_x$ and $B_x$ has a plurality of connector fingers of a first set, represented here by fingers 531 and 631, and a plurality of connector fingers of a second set, represented by fingers 571 and 671, all in accordance with invention. Jack $C_x$, which is this embodiment is provided for monitoring only, has fingers of the prior art type only, as represented by finger 731.

When no plug is inserted in either jack $A_x$ or $B_x$, the fingers of the first and second sets in each, 531–571 and 631–671, make contact and signals can pass between connectors D and E. A plug can be inserted in jack $C_x$ to monitor that signal without any switching. When a plug is inserted in either or both of jacks $A_x$ and $B_x$, signals are no longer connected between connectors D and E in those jacks. This switching occurs automatically within the jacks as described above, without need for any additional switches or patch ends between the jacks. Jack $C_x$ can still be used to monitor the signal at jack $B_x$. Another jack could similarly be provided for monitoring the signal at jack $A_x$.

Although my invention has been described with respect to particular embodiments employing an RJ-45 type jack, it will be clear to those skilled in the art that the invention is not limited to that type of connector and is limited only by the following claims.

I claim:

1. In a connector jack comprising a body, a cavity in said body for receiving a mating plug, and a plurality of generally parallel electrode fingers within said cavity constituting a first set of mutually electrically insulated fingers for connection through the jack to said plug, the fingers of said first set extending in a common plane rearwardly and into said cavity at an acute angle from one side of said cavity, wherein the improvement comprises a plurality of mutually electrically insulated contacts located near the bottom of the cavity, each of said contacts being arranged for electrical connection to a single corresponding finger of said first set when said plug is not present in said cavity and for disconnection of the fingers of said first set from the corresponding contacts when said plug is fully inserted in said cavity.

2. The connector jack of claim 1 wherein each of said contacts is on a finger of a second set of fingers.

3. In a connector jack comprising a body, a cavity in said body for receiving a mating plug, and a plurality of generally parallel electrode fingers within said cavity constituting a first set of mutually electrically insulated fingers for connection through the jack to said plug, wherein the improvement comprises a second set of a plurality of mutually electrically insulated fingers arranged for electrical connection to corresponding fingers of said first set when said plug is not present in said cavity and for disconnection of the fingers of said first set from the fingers of the second set when said plug is fully inserted in said cavity, and a plurality of pockets in said body at the rear of said cavity, with one finger of said first set and one finger of said second set in each of said pockets, said pockets laterally restraining and aligning the fingers in the pocket.

4. The connector jack of claim 3 wherein each of said plurality of pockets which is occupied by fingers has one finger of the first set entering the pocket from the cavity and one finger of the second set entering from another side.

5. The connector jack of any of claim 4 wherein the tip of each of the fingers of said second set is formed in a small radius.

6. The jack of any of claims 1–4 wherein said cavity and said first set of fingers are adapted for use with a mating plug of the RJ-11 type.

7. The jack of any of claims 1–4 wherein said cavity and said first set of fingers are adapted for use with a mating plug of the RJ-45 type.

8. A device for converting a non-switching connector jack to a switching jack, applicable to connector jacks of the type comprising a body, a cavity within said body for receiving a mating plug, and a plurality of generally parallel electrode fingers within said cavity, constituting a first set of fingers for connection through said jack to said plug, the device comprising an insulating support, a second set of a plurality of fingers adhered to said support and arranged to fit into the cavity of said jack for connection to corresponding fingers of said first set when said plug is present in said cavity and for disconnection of the fingers of said first set when said plug is fully inserted in said cavity.

9. The device of claim 8 wherein the tip of each of the fingers of said second set is formed in a small radius.

10. A patch panel comprising a plurality of connector jacks in accordance with any of claims 1–4, 8 or 9.

11. The patch panel of claim 10 further comprising at least two additional connectors (D, E), wherein a plurality of said connector jacks (Ax, Bx) are arranged in pairs with the fingers of the first set of one of connector jack (Ax) of each pair connected to one of said additional connectors (D), the fingers of the first set of the other connector jack (Bx) of each pair connected to the other of said additional connectors (E), and the fingers (571) of the second set of one connector jack (Ax) of each pair being externally connected (Ix) to corresponding fingers (671) of the other connector jack (Bx) of said pair.

12. The connector jack of claim 10 wherein the tip of each of the fingers of said second set is formed in a small radius.

13. The connector jack of any of claims 2–4, 11, or 12 wherein the fingers of the first set are arranged to be moved away from the fingers of the second set by the insertion of a mating plug.

* * * * *